US011470917B1

(12) United States Patent
Norton

(10) Patent No.: US 11,470,917 B1
(45) **Date of Patent: *Oct. 18, 2022**

(54) SYSTEM AND METHOD FOR INSERT

(71) Applicant: OPVET Inc., Temple, TX (US)

(72) Inventor: Daniel E. Norton, Happy Valley, OR (US)

(73) Assignee: OPVET Inc., Temple, TX (US)

( * ) Notice: Subject to any disclaimer, the term of this patent is extended or adjusted under 35 U.S.C. 154(b) by 29 days.

This patent is subject to a terminal disclaimer.

(21) Appl. No.: 17/353,777

(22) Filed: Jun. 21, 2021

Related U.S. Application Data

(63) Continuation-in-part of application No. 29/795,908, filed on Jun. 21, 2021, which is a continuation of application No. 13/940,598, filed on Jul. 12, 2013, now Pat. No. 11,039,656.

(51) Int. Cl.

| | |
|---|---|
| ***A43B 13/02*** | (2022.01) |
| ***A43B 13/18*** | (2006.01) |
| ***A43B 19/00*** | (2006.01) |
| ***A43B 7/149*** | (2022.01) |
| ***A43B 7/1405*** | (2022.01) |

(52) U.S. Cl.
CPC ..... *A43B 19/00* (2013.01); *A43B 7/141* (2013.01); *A43B 7/149* (2013.01)

(58) Field of Classification Search
CPC ..... A43B 19/00; A43B 7/141; A43B 7/149
See application file for complete search history.

(56) References Cited

U.S. PATENT DOCUMENTS

| | | | | |
|---|---|---|---|---|
| 2,532,742 | A * | 12/1950 | Stoiner | A43B 21/28 36/35 B |
| 5,313,717 | A * | 5/1994 | Allen | A43B 13/20 36/28 |
| 5,649,374 | A * | 7/1997 | Chou | A43B 21/30 36/38 |
| 5,881,478 | A * | 3/1999 | McMahon | A43B 13/181 36/144 |
| 7,152,339 | B2 * | 12/2006 | Lo | A43B 7/08 36/3 R |
| 7,757,411 | B2 * | 7/2010 | Nakano | A43B 21/26 36/38 |
| 7,937,854 | B2 * | 5/2011 | Kilgore | A43B 13/181 36/37 |
| 8,056,261 | B2 * | 11/2011 | Nakano | A43B 13/12 36/35 R |
| 8,166,673 | B2 * | 5/2012 | Sills | A43B 1/0072 36/29 |
| 8,555,526 | B2 * | 10/2013 | Elnekaveh | A43B 1/0054 36/103 |
| 2006/0130364 | A1 * | 6/2006 | Greene | A43B 7/1425 36/28 |
| 2009/0019729 | A1 * | 1/2009 | Nakano | A43B 7/14 36/91 |

(Continued)

*Primary Examiner* — Jila M Mohandesi
(74) *Attorney, Agent, or Firm* — Christopher Mayle; Bold IP, PLLC

(57) ABSTRACT

A system and method directed for a footwear insert whereby the insert provides a more efficient and durable method for providing cushioning in footwear and utilizes a cushioning method that uses deflection as a way to provide cushioning similar to a trampoline that is durable, retains its shape over time, and has very little energy loss.

9 Claims, 2 Drawing Sheets

(56) References Cited

U.S. PATENT DOCUMENTS

| | | | | |
|---|---|---|---|---|
| 2009/0139113 | A1* | 6/2009 | Buethorn | B29C 33/3857 36/140 |
| 2010/0299958 | A1* | 12/2010 | Mazzarolo | A43B 7/144 36/28 |
| 2011/0000101 | A1* | 1/2011 | Nakano | A43B 7/144 36/12 |
| 2014/0075779 | A1* | 3/2014 | Bruce | A43B 13/20 36/29 |
| 2015/0013182 | A1* | 1/2015 | Norton | A43B 13/18 36/28 |

* cited by examiner

SYSTEM AND METHOD FOR INSERT

FIELD OF DISCLOSURE

This application claims priority to U.S. application Ser. No. 29/795,908 filed on Jun. 21, 2021 which claims priority to U.S. patent application Ser. No. 13/940,598 filed on Jul. 12, 2013.

BACKGROUND

Conventional cushioning devices in footwear provide cushioning using the method of compression (usually via the incorporation of a foam material within the heel and sole of a shoe) to absorb shock within the footwear as a user is walking or running and the bottom of the footwear strikes the ground. Cushioning by compression is simply the process of compressing the material that is under your foot until it bottoms out with each step or stride. The drawback of using compression as a method of cushioning is that this form of cushioning has a high level of energy loss, deforms quickly, and loses up to 30% of its cushioning capabilities within the first 200 miles of use. Two hundred miles of use is equivalent to 400,000 steps walking or 40,000 strides running. Thus exists the need for a new cushioning device.

SUMMARY

The disclosure presented herein relates to a footwear insert for insertion into a shoe, the footwear insert having a housing, the housing having an elastic plate positioned over a cavity, further including a post to limit movement of the elastic plate in the cavity, an aperture on a top surface, the aperture positioned above the cavity whereby the elastic plate does not fully cover the aperture, whereby the elastic plate is positioned in grooves on sidewalls of the cavity, whereby the top surface covers side edges of the elastic plate, the footwear insert having a curving front sloping portion extending into a rectangular prism shaped rear portion, whereby the cavity is in the rear portion, whereby the top surface extends between the front portion and the rear portion, whereby the top surface has an hourglass shape, whereby the elastic plate is made of carbon fiber, whereby the housing is made of a thermoplastic material The disclosure presented herein also relates to a footwear insert for insertion into a shoe, the footwear insert having a curving front sloping portion extending into a rectangular prism shaped rear portion, the housing having an elastic plate positioned over a cavity in the rear portion, further including a post positioned at a bottom wall of the cavity to limit movement of the elastic plate, whereby the bottom wall of the cavity is positioned above a bottom surface of the footwear insert, further including an aperture on a top surface, the aperture positioned above the cavity whereby the elastic plate does not fully cover the aperture, whereby the elastic plate is positioned in grooves on the sidewalls of the cavity, the top surface covering side edges of the elastic plate, the top surface connected to the bottom surface by side surfaces that extend into a back surface positioned at the rear of the footwear insert, the bottom surface extending upward into an elongated sloping concave surface whereby the bottom surface and the elongated sloping concave surface is equal in length to the top surface, the top surface and the elongated sloping concave surface connected by a front surface positioned at the front of the footwear insert, the back surface having an arch shape.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
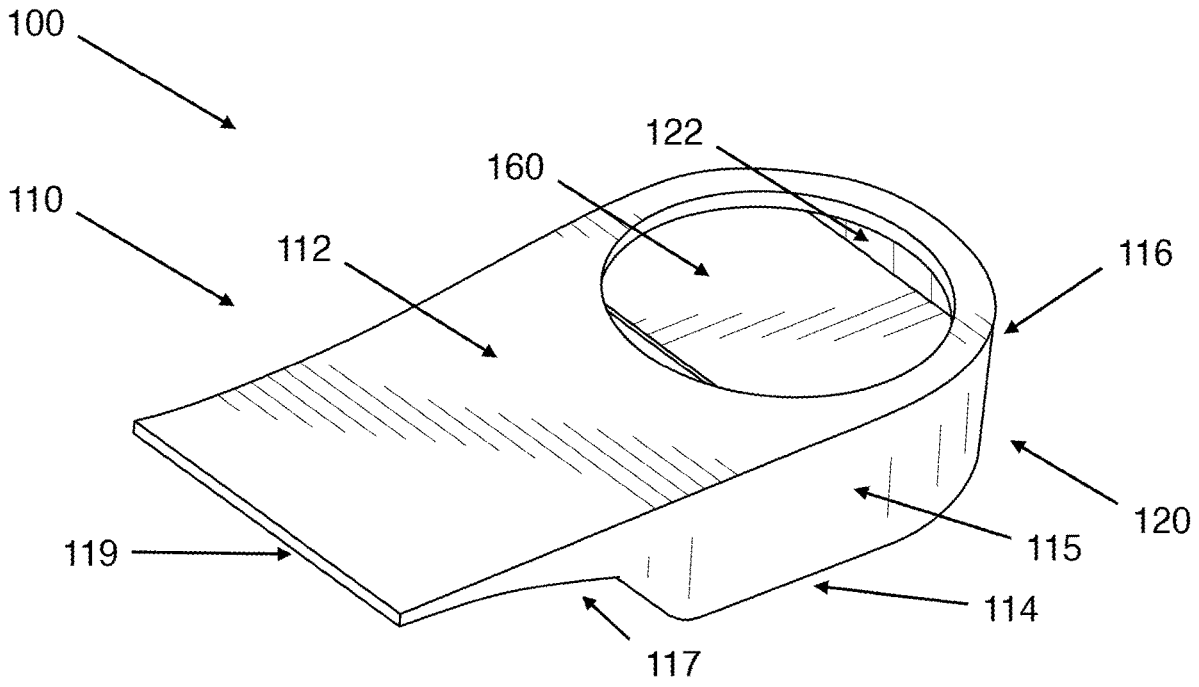
FIG. 1 illustrates an embodiment of the footwear insert

In the Summary above and in this Detailed Description, and the claims below, and in the accompanying drawings, reference is made to particular features of the invention. The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined).

"Exemplary" is used herein to mean "serving as an example, instance, or illustration." Any aspect described in this document as "exemplary" is not necessarily to be construed as preferred or advantageous over other aspects Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items," may indicate the presence of only one item, or may indicate more items. Thus, the term "set" may be equivalent to "one or more" as used herein.

In the following detailed description, numerous specific details are set forth in order to provide a more thorough understanding of the one or more embodiments described herein. However, it will be apparent to one of ordinary skill in the art that the invention may be practiced without these specific details. In other instances, well-known features have not been described in detail to avoid unnecessarily complicating the description.

The present disclosure is generally drawn to a system and method, according to one or more exemplary embodiments, for a footwear insert. The footwear insert provides a more efficient and durable method for providing cushioning in footwear and utilizes a cushioning method that uses deflection as a way to provide cushioning similar to a trampoline that is durable, retains its shape over time, and has very little energy loss. The footwear insert is designed to be used in the heel area of a variety of types of footwear not limited to but including athletic, casual, military, hiking, and dress shoes.

The advantages of the footwear insert include, without limitation, superior cushioning compared to current cushioning technology, energy return in a manner and degree not utilized in current footwear cushioning shock attenuation systems, lighter weight than most, if not all, current systems, simple design and construction for ease of manufacturing, superior durability than current shock attenuation systems, and tenability for varied weight loads or functions.

Figure 2:
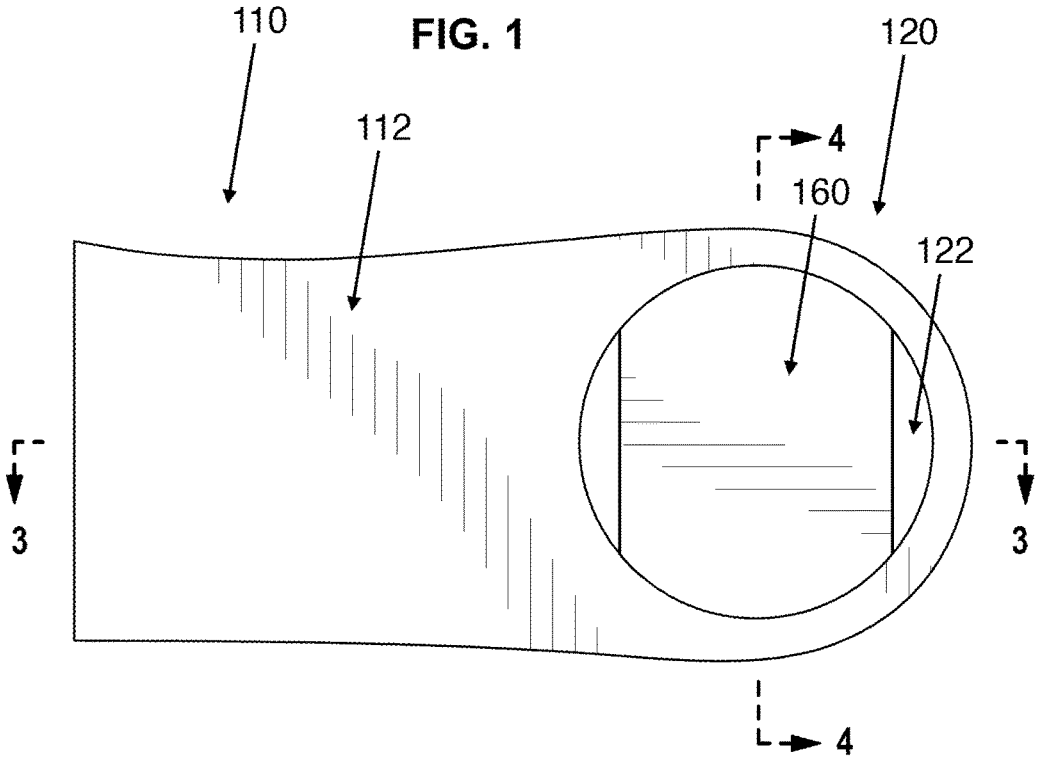
FIG. 2 illustrates a top view of the footwear insert.

With reference now to FIG. 1 and FIG. 2, one exemplary embodiment of footwear insert is shown. Footwear insert 100 may have a curving front sloping portion 110 extending into a rectangular prism shaped rear portion 120 whereby footwear insert 100 would be placed in a shoe with rear portion 120 at the back of the shoe. However, this is non-limiting and footwear insert 100 may be placed along any length of a shoe. Footwear insert 100 may be made of a durable mix of rigid plastic, synthetic, and nylon materials. Although it is envisioned that footwear insert 100 may also be made of metal or another suitable material, a thermoplastic housing is preferred because it will reduce weight and manufacturing costs.

Front portion 110 and rear portion 120 share a common top surface 112 that is parallel to a bottom surface 114 of rear portion 120 whereby top surface 112 is longer than bottom surface 114 and extends past a front edge of bottom surface 114. Top surface 112 may be connected to bottom surface 114 by side surfaces 115 that extend into an arching back surface 116 positioned at the rear of footwear insert 100 whereby side surfaces 115 and back surface 116 is perpendicular to top surface 112 and bottom surface 114. Opposite of the end connected to back surface 116, another end of bottom surface 114 may extend upward into an elongated sloping concave surface 117 whereby the length of bottom surface 114 and concave surface 117 is equal to that of top surface 112. Top surface 112 and concave surface 117 may be connected by a front surface 119 positioned at the front of footwear insert 100 whereby front surface 119 is perpendicular to top surface 112 and bottom surface 114.

Figure 3:
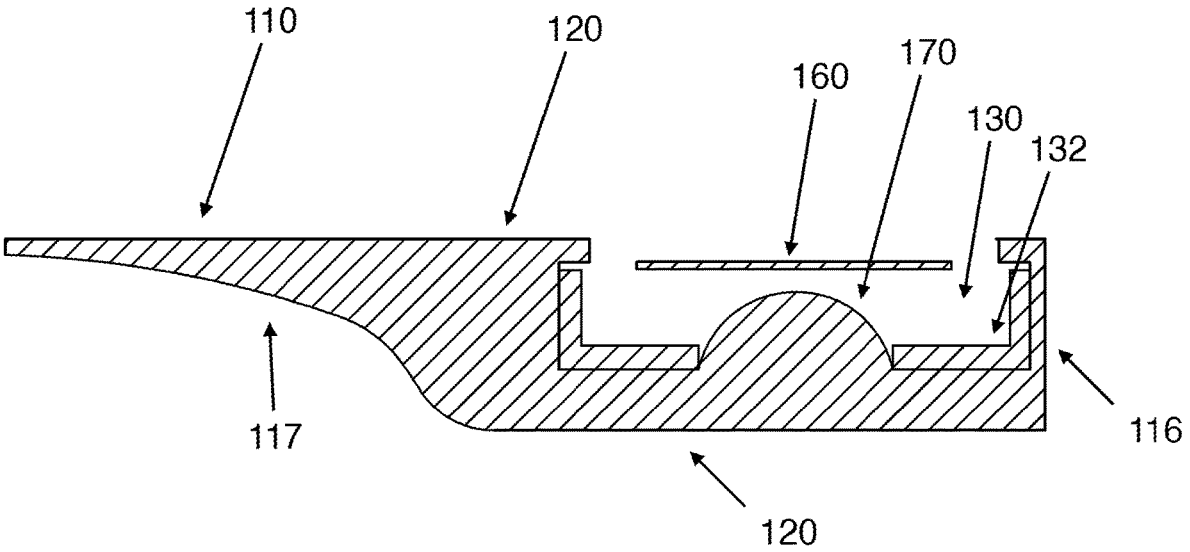
FIG. 3 illustrates a cross sectional view of FIG. 2.
Figure 4:
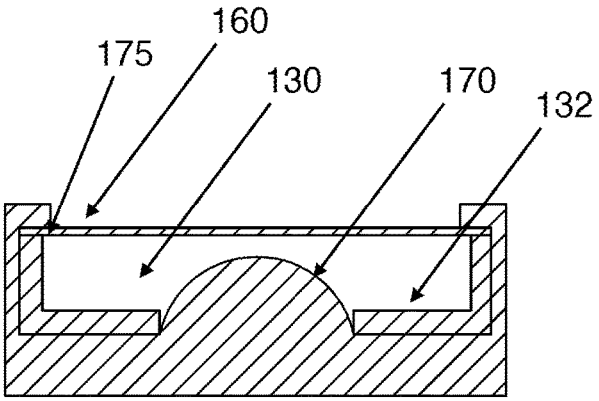
FIG. 4 illustrates a cross sectional view of FIG. 2.

Top surface 112 may have an hourglass shape with a middle portion that is of a smaller area than a rectangular front portion and rear portion of top surface 112. The rear portion of top surface 112 may have a circular shape with a circular shaped aperture 122 extending through top surface 112 whereby aperture 122 is a majority of the area of the rear portion of top surface 112. Aperture 122 may extend downward into a cavity 130 positioned in rear portion 114 whereby aperture 122 and cavity 130 are in fluid communication such that air may enter through aperture 122 into cavity 130 and then once again exit out from aperture 122, as illustrated in FIG. 3 and FIG. 4. Cavity 130 may have a rectangular or square shape and extend downward a length of rear portion 114 whereby a bottom surface 132 of cavity 130 is positioned above bottom surface 114 such that cavity 130 does not extend to the bottom of footwear insert 100.

Cavity 130 may have a front wall, rear wall, and sidewalls extending between the front wall and the rear wall. An elastic plate 160 may be inserted into grooves 175 positioned on sidewalls of cavity 130 such that grooves 175 are on side surfaces 115 of footwear insert 100. This location is advantageous because elastic plate 160 may flex unrestricted when placed under a load by the heel of a user's foot on the elastic plate during activity. The preferable material used for elastic plate 160 is elastic materials such as carbon fiber and/or other elastic composite materials that have a very high rate of rebound (energy return) and a high resistance to breakdown when stressed and released under pressure. These types of elastic materials can be engineered so that the spring constant properties can be modified to accommodate the user's different weights by shoe size, activity, and function.

The elastic plate 160 is designed so that it does not completely cover the cavity 130 when it is placed to rest upon grooves 175 in cavity 130 so that air under the elastic plate 160 can escape up and out of the cavity 130 through gaps formed where edges of the elastic plate 160 do not contact footwear insert 100 when it is flexed downward by the foot, and so that air pressure does not affect the function of the total device. As well, aperture 122 is designed to cover and protect the connection between elastic plate 160 and grooves 175 of cavity 130 whereby top surface 112 covers the side edges of elastic plate 160. Referring to the function of the invention, when the elastic plate 160 is put under load from activities such as walking and running, a high level of energy return can be achieved due to the fact that the plate is not anchored or restricted at any point, thus allowing it to bend and return freely. The invention functions similar in a way a trampoline functions by storing, releasing, and returning a high amount of elastic energy.

A post 170 may be positioned in cavity 130 extending upward from bottom surface 132 whereby post 170 may limit the amount of deflection by elastic plate 160 into the cavity. Post 170 may have a hemispherical shape or in other non-limiting embodiments a rounded shape of any angle. Post 170 may function as a fail-safe stop so the elastic plate 160 will not flex excessively and break. Flexion beyond the post 170 within the cavity 130 could result in the elastic plate 160 breaking or shattering. When the load is released by the heel as the motion of the foot pronates forward, elastic plate 160 will use kinetic energy to return to its original shape thus providing energy return to the wearer.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated.

What is claimed is:

1. A footwear insert for insertion into a shoe, the footwear insert having a housing, the housing having an elastic plate positioned over a cavity, the footwear insert having a flat bottom surface extending upward into an outward facing sloping concave surface wherein the bottom surface and the sloping concave surface span an equal length to a top surface positioned above the elastic plate, the footwear insert having a hole positioned through the top surface, the hole positioned above the cavity wherein the elastic plate does not fully cover the circular hole.

2. The footwear insert of claim 1 further comprising a post that limits movement of the elastic plate in the cavity.

3. The footwear insert of claim 1, wherein the elastic plate is positioned in grooves on sidewalls of the cavity, wherein the cavity is a rectangular prism in shape.

4. The footwear insert of claim 3, wherein the top surface covers side edges of the elastic plate.

5. The footwear insert of claim 4, the footwear insert having a curving front sloping portion extending into a rectangular shaped rear portion, wherein the cavity is in the rear portion.

6. The footwear insert of claim 1, wherein the top surface extends past a bottom surface along a horizontal axis, the top surface connected to the bottom surface by a curving surface.

7. The footwear insert of claim 6, wherein the top surface has a rectangular potion extending into an arching portion.

8. The footwear insert of claim 1, wherein the elastic plate is made of carbon fiber.

9. The footwear insert of claim 1, wherein the housing is made of a thermoplastic material.

* * * * *